US005540854A

United States Patent [19]

Fair et al.

[11] Patent Number: 5,540,854

[45] Date of Patent: Jul. 30, 1996

[54] POLYALKYLENE STRUCTURED DETERGENT BARS COMPRISING ORGANIC AMIDE

[75] Inventors: Michael J. Fair, Saddle Brook; Terence Farrell, Guttenberg, both of N.J.

[73] Assignee: Lever Brothers Company, Division of Conopco, Inc., New York, N.Y.

[21] Appl. No.: 431,171

[22] Filed: Apr. 28, 1995

[51] Int. Cl.[6] ..... C11D 3/32; C11D 3/43; C11D 3/46; C11D 17/00

[52] U.S. Cl. ..... 510/152; 510/154; 510/155

[58] Field of Search ..... 252/134, 174, 252/117, DIG. 16, 118, 544, 153

[56] References Cited

U.S. PATENT DOCUMENTS

| | | | |
|---|---|---|---|
| 3,991,001 | 11/1976 | Srinivassan et al. | 252/117 |
| 4,234,464 | 11/1980 | Morshauser | 252/544 |
| 4,695,395 | 9/1987 | Caswell et al. | 252/121 |
| 5,064,555 | 11/1991 | Medcalf, Jr. et al. | 252/117 |
| 5,096,608 | 3/1992 | Small et al. | 252/132 |

FOREIGN PATENT DOCUMENTS

| | | |
|---|---|---|
| 2627459 | 1/1977 | Germany . |
| 1489156 | 10/1977 | United Kingdom . |

*Primary Examiner*—Erin M. Harriman
*Attorney, Agent, or Firm*—Ronald A. Koatz

[57] ABSTRACT

The present invention relates to synthetic bar compositions comprising minimum levels of polyalkylene glycol. Addition of organic amide to such compositions has been found to provide unexpected benefits, i.e., in preventing phase separation.

3 Claims, No Drawings

POLYALKYLENE STRUCTURED DETERGENT BARS COMPRISING ORGANIC AMIDE

FIELD OF THE INVENTION

The present invention relates to bar compositions, especially synthetic soap bar compositions, which compositions comprise minimum levels of polyalkylene glycol to structure the bars. Addition of an organic amide compound (i.e., generally characterized as acyl group —$CONH_2$ attached to an organic group R, wherein R is hydrogen, $NH_2$ or substituted or unsubstituted, straight or branched chain hydrocarbyl group having 1–20 carbons), preferably a carbamide such as urea to such compositions has been found to provide unexpected processing benefits.

BACKGROUND OF THE INVENTION

Soap is an efficient cleaning surfactant which has been used historically in toilet bar compositions. Because soap can be harsh on the skin, however, for many years it has been sought to find a milder (i.e., less harsh) surfactant which can be used together with or in place of soap in such toilet bar compositions. U.S. Pat. No. 4,695,395 to Caswell et al., for example, teaches a toilet bar composition comprising both soap and acyl fatty isethionate and which composition is substantially milder to the skin then pure soap.

In such non-soap detergent active bars, free fatty acid is generally used to structure the bars (i.e., keep them from physically falling apart).

Fatty acids, however, are not the only materials which can be used to provide bar structuring. In U.S. Ser. No. 08/148,120 to Massaro et al., for example, applicants teach that polyalkylene glycol is a preferred structurant, at least when used with aldobionamide surfactants, because they provide good structuring characteristics without simultaneously inhibiting lather formation.

In another copending application, i.e., U.S. Ser. No. 08/213,287 to Chambers, applicants teach compositions comprising 10–60% of a synthetic non-soap surfactant as well as 10–60% of a water soluble structurant having a melting point in the range of 40°–100° C. A preferred structurant is said to be a polyalkylene glycol such as polyethylene glycol.

The use of polyalkylene glycol structurant, while beneficial, often comes at the expense not only of fatty acid (if at all), but also of the non-soap surfactant. When the non-soap surfactant is, for example, directly esterified isethionate (e.g. DEFI), this can be detrimental because DEFI in itself has a stabilizing effect on the composition (i.e., helps to stop compositions from phase separating).

Thus, the use of polyethylene glycol and the simultaneous use of lower amounts of DEFI than normally used can cause the type of phase separation that makes such bars very difficult to process.

Unexpectedly, applicants have found that certain organic amide compounds (e.g., urea) interact with such PEG/lower DEFI formulations in such a way that phase separation is avoided.

Organic amides such as urea have been used in soap bar compositions such as is taught in U.S. Pat. No. 3,991,001 to Srinivasan et al.; for example, to improve lathering properties. Soap bar compositions, however, do not have the phase separation problems noted above associated with PEG/relatively low DEFI bars and there is no recognition that the organic amide could be used to stop such separation and aid in bar processing.

German Patent 2,627,459 to Twenlow (assigned to Unilever) teaches the use of amides such as urea in compositions comprising 48.6% sodium acyl isethionate (i.e., DEFI). This amount of DEFI is high enough to help in the phase formation of the bar such that there would not be the type of phase separation noted when PEG is added and the DEFI levels are lowered (i.e., to under about 40% by wt. DEFI in the detergent bar).

Unexpectedly, applicants have found that, even in bars comprising polyalkylene glycol and under about 40% by wt. DEFI, the phase separation problem otherwise seen disappears when organic amides, such as urea, are in the composition.

SUMMARY OF THE INVENTION

Unexpectedly, applicants have found that addition of organic amide to detergent composition having less than about 40% by weight isethionate allows greater amounts of polyalkylene glycol to be incorporated into the bar composition while simultaneously preventing phase separation.

In one embodiment of the invention, the invention relates to synthetic bar compositions comprising:

(a) 10 to 60% by wt. of a detergent surfactant;

(b) at least 10% to 60% by wt. of polyalkylene glycol;

(c) 5% to 25% water insoluble structurant (e.g., fatty acid);

(d) 0.1% to 15% by wt. organic fatty acid amide; and (e) 1.00 to 14% by wt. water;

wherein, to the extent the surfactant comprises isethionate, no more than about 40% by wt. of total composition comprises isethionate.

In a preferred embodiment of the invention, the composition comprises 5 to 50% by wt., preferably 5 to 25% by wt. of a water soluble material.

In a second embodiment of the invention, the invention relates to a process for making a homogeneous synthetic surfactant bar which bar comprises:

(a) 10% to 60% by wt. detergent surfactant;

(b) at least 10% to 60% by wt. of polyalkylene glycol;

(c) 5% to 25% water insoluble structurant; and (d) 1% to 14 % by wt. water;

wherein no more than 40% of the composition comprises DEFI, which process comprises adding 0.1 to 15% organic acid amide (e) to a mixture of compound (b), (c) and (d) above, then adding (a), and mixing from about 10 minutes to 2 to 3 hours at a temperature of 180° C. to 240° C.

DETAILED DESCRIPTION OF THE INVENTION

The present invention relates to synthetic bar compositions, particularly those containing relatively low levels of DEFI (i.e., under about 40% by wt. of composition) and having minimum levels of polyalkylene glycol used to structure the bars.

The addition of certain levels of polyalkylene glycol to synthetic bar compositions introduces certain processing difficulties because the polyalkylene glycol generally melts at temperatures used for mixing components during the formation of the bars and easily phase separates. When greater than 40% or 45% DEFI is used, this helps stabilize the polyalkylene glycol from phase separation, but it is not always desirable or economical to use this amount of isethionate. Unexpectedly, applicants have found that introduction of fatty acid amides (e.g., urea) into such relatively low DEFI, high polyol glycol compositions helps to prevent phase separation.

In one embodiment of the invention, the invention relates to synthetic bar compositions comprising:

(a) 10% to 60% by wt. of detergent surfactant;

(b) at least 10% to 60% by wt. of polyalkylene glycols.

(c) 5% to 25% fatty acid;

(d) 0.1% to 15%, preferably 0.1% to 10%, more preferably 0.5% to 8%, most preferably 1.0% to 5% organic amide compound; and (e) 1% to 14%, preferably 1% to 9% water.

wherein, the amount of DEFI is no more than about 40% by wt, i.e., 10% to 40% by wt. of the composition.

The first component of the composition is a detergent. Suitable synthetic detergents (a) are: alkyl ether sulphates; alkylethoxylates; alkyl glyceryl ether sulphonates; alpha olefin sulphonates; acyl taurides; methyl acyl taurates; N-acyl glutamates; acyl isethionates; anionic acyl sarcosinates; alkyl phosphates; methyl glucose esters; protein condensates; ethoxylated alkyl sulphates; alkyl polyglucosides; alkyl amine oxides; hetaines; sultaines; alkyl sulphosuccinates, dialkyl sulphosuccinates, acyl lactylates and mixtures thereof. The above-mentioned detergents are preferably those based upon $C_8$ to $C_{24}$, more preferably those based upon $C_{10}$ to $C_{18}$, alkyl and acyl moieties.

The detergent can also be a fatty acid soap such as sodium or potassium soap of $C_{12}$–$C_{24}$ acid (for example stearic/palmitic mixtures) and, preferably 2 to 10% by wt., more preferably 2 to 5% of such soap are used. Preferred soaps include sodium stearate.

For many embodiments of this invention, the amount of synthetic detergent (a) may lie in the range from 10 to 50% wt. Further preferences are at least 10% and not more than 40%, preferably not more than 35%.

A preferred synthetic soap is acyl isethionate having the formula $$R-\overset{\overset{\displaystyle O}{\|}}{C}-O-CH_2CH_2SO_3M$$

in which R is a saturated, linear or branched alkyl group and M denotes an alkali metal or alkaline earth metal or amine. While preferred, this compound should not be used in an amount greater than 40% by wt. of the composition, preferably 10% to 40% by wt.

The polyalkylene glycol component (b) which is used is preferably a high molecular weight polyalkylene glycol of melting point for about 40° to 100° C. and in particular polyethylene glycols or mixtures thereof.

Polyethylene glycols (PEG's) which are used may have a molecular weight in the range 1,500–10,000. However, in some embodiments of this invention it is preferred to include a fairly small quantity of polyethylene glycol with a molecular weight in the range from 50,000 to 500,000, especially molecular weights of around 100,000. Such polyethylene glycols have been found to improve the wear rate of the bars. It is believed that this is because their long polymer chains remain entangled even when the bar composition is wetted during use.

If such high molecular weight polyethylene glycols (or any other water soluble high molecular weight polyalkylene oxides) are used, the quantity is preferably from 1% to 5%, more preferably from 1% or 1.5% to 4% or 4.5% by weight of the composition. These materials will generally be used jointly with a larger quantity of other water soluble structurant (b) such as the above mentioned polyethylene glycol of molecular weight 1,500 to 10,000.

Some polyethylene oxide polypropylene oxide block copolymers melt at temperatures in the required range of 40° to 100° C. and may be used as part or all of the water soluble structurant (b). Preferred here are block copolymers in which polyethylene oxide provides at least 40% by weight of the block copolymer. Such block copolymers may be used, in mixtures with polyethylene glycol or other water soluble structurant.

Preferably, the total quantity of polyalkylene glycol is from 20% to 50% by wt of the composition.

Water insoluble structurants, component (c), should also have a melting point in the range 25°–100°, more preferably at least 40° C. to 90° C. Suitable materials which are particularly envisaged are fatty acids, particularly those having a carbon chain of 12 to 24 carbon atoms. Examples are lauric, myristic, palmitic, stearic, arachidonic and behenic acids and mixtures thereof. Sources of these fatty acids are coconut, topped coconut, palm, palm kernel, babassu and tallow fatty acids and partially or fully hardened fatty acids or distilled fatty acids. Other suitable water insoluble structurants include alkanols of 8 to 20 carbon atoms, particularly cetyl alcohol. These materials generally have a water solubility of less than 5 g/liter at 20° C.

The relative proportions of the water soluble structurants (b) and water insoluble structurants (c) govern the rate at which the bar wears during use. The presence of the water insoluble structurant tends to delay dissolution of the bar when exposed to water during use and hence retard the rate of wear.

Preferably the; total quantity of component (c) is from 5% to 25% by weight of the composition.

Preferably, the composition comprises a water soluble material (e.g., starch), more preferably a "true" water soluble starch such as, for example, maltodextrin. By "true" water soluble is meant 10% by wt. or greater solution of the starch in water will dissolve to form a clear or substantially clear solution (except for small amounts of insoluble residue which may impart a translucent haziness to otherwise clear solution).

The key to the subject invention is the discovery that use of organic amide compounds (e.g., urea) in compositions comprising DEFI and polyethylene glycol can prevent phase separation, even when DEFI, a good stabilizer, comprises less than 40% of the composition. Accordingly, the invention further contemplates the use of organic amide as a processing aid.

The organic amide should be used in an amount from about 0.1 to 15%, preferably 0.1% to 10% by wt., more preferably 0.5% to 8% by wt.

Water should be used in an amount 1.0% to 14% by weight of the composition.

A certain amount of free fatty acids of 8 to 22 carbons are also desirably incorporated (although in theory they need not be incorporated) into the bar compositions to act as superfatty agents, skin feel and creaminess enhancers, and/or structurants. If present, the free fatty acids should comprise between 1 and 15% by weight of the compositions, but should comprise no more than the amount of polyalkylene glycol present.

Other optional ingredients which may be present in toilet bar compositions are moisturizers such as glycerin, sorbitol, ethoxylated or methoxylated ether of methyl glucose etc; water soluble polymers such as collagens, modified cellulases (such as Polymer JR®), guar gums and polyacrylates; sequestering agents such as citrate, and emollients such as silicones, mineral oil, petrolatum, or fluorinated polyethers.

In a second embodiment of the invention, the invention comprises a method for stabilizing (i.e., preventing phase separation) of a synthetic detergent bar comprising:

(a) synthetic surfactant;

(b) polyalkylene glycol;

(c) insoluble structurant; and (d) water;

which process comprises adding organic fatty acid amide (e) to a container holding components (b), (c) and (d), then adding surfactant (a) and mixing said components at a temperature of 180° C. to 240° C. for 10 to 180 minutes.

The invention is set forth in greater detail in the examples which follow below. These examples are for illustrative purposes only and are not intended to be limiting in any way.

Unless stated otherwise, all percentages used in this specification and examples are intended to be by weight.

EXAMPLES 1–4

Formulation having the following compositions were prepared (all percentages were percentages by wt.):

| Ingredient | comparative formulation | example 1 | example 2 | example 3 | example 4 |
|---|---|---|---|---|---|
| PEG 8000 | 35 | 34 | 32 | 30 | 25 |
| Urea | — | 1 | 3 | 5 | 10 |
| Na cocoyl isethionate | 27.0 | 27.0 | 27.0 | 27.0 | 27.0 |
| Palmitic-stearic acid | 12 | 12 | 12 | 12 | 12 |
| Coco amido-propyl betaine | 5.0 | 5.0 | 5.0 | 5.0 | 5.0 |
| maltodextrin | 10.0 | 10.0 | 10.0 | 10.0 | 10.0 |
| Na stearate | 5.0 | 5.0 | 5.0 | 5.0 | 5.0 |
| Dimethicone | 0.25 | 0.25 | 0.25 | 0.25 | 0.25 |
| EHDP | 0.02 | 0.02 | 0.02 | 0.02 | 0.02 |
| EDTA | 0.02 | 0.02 | 0.02 | 0.02 | 0.02 |
| Titanium dioxide | 0.5 | 0.5 | 0.5 | 0.5 | 0.5 |
| Fragrance | 0.25 | 0.25 | 0.25 | 0.25 | 0.25 |
| Misc. Salts | 1.96 | 1.96 | 1.96 | 1.96 | 1.96 |
| Water | 6.0 | 6.0 | 6.0 | 6.0 | 6.0 |

It should be noted that, while in the above table all variations in urea levels were compensated for by changes in PEG 800, the amount could also have been compensated for by changes in fatty acid, for example.

The formulations were prepared as follows:

In a Drais mixer, PEG and palmitic/stearic acid (ASAD) were melted. When molten, 50% NaOH (sodium hydroxide) was added to form Na stearate, and this was mixed for 10–15 minutes. Maltodextrin was then dispersed in the PEG/fatty acid premelt and cocoamidopropyl betaine was added to thicken the mixture. After about 10 minutes of mixing, the remaining ingredients were added. Mixing continued for an additional 30–60 minutes at temperatures of at least 190° F. up to 230° F. Once at the required moisture, the batch was removed from the mixture for further processing.

In the comparative formulation (i.e., no urea), the hot material consisted of large opaque curd-like domains surrounded by an oily liquid. This "cottage cheese" appearance is termed phase separation because a clear fluid separates out from the bulk of the material. This phase separation results in inadequate mixing and processing problems further down the line.

In the first example 1% urea was added to the PEG/fatty acid premelt (this replaced 1% PEG). Applicants found that the "cottage cheese" appearance unexpectedly had a more homogeneous consistency with virtually no fluid separating out from the bulk material.

In Example 2, 3% urea was added at the expense of PEG. This gave the hot material a homogeneous appearance with no phase separation. Examples 3 and 4 further illustrated this finding.

Comparative 2

In the following example, an additional 3% fatty acid was added in place of PEG. This was done to determine if the decrease in PEG would give the hot material a homogeneous appearance.

| Ingredient | Comparative |
|---|---|
| PEG 8000 | 32 |
| Urea | — |
| Na cocoyl isethionate | 27.0 |
| Palmitic-stearic acid | 15 |
| Coco amodipropyl betaine | 5.0 |
| maltodextrin | 10.0 |
| Na stearate | 5.0 |
| Dimethicone | 0.25 |
| EHDP | 0.02 |
| EDTA | 0.02 |
| Titanium dioxide | 0.5 |
| Fragrance | 0.25 |
| Misc. Salts | 1.96 |
| Water | 6.0 |

It was found that by adding additional fatty acid with no urea, no improvement in phase separation was observed. The hot material maintained the "cottage cheese" appearance. Thus, the improvement was clearly due to use of urea.

What is claimed is:

1. A synthetic bar composition comprising:

(a) 10% to about 40% by wt. of a detergent surfactant selected from the group consisting of alkyl ether sulphates; alkylalkoxylates; alkyl glyceryl ether sulphonates; alpha olefin sulphonates; acyl taurides; methyl acyl taurates; N-acyl glutamates; acyl isethionates; anionic acyl sarcosinates: alkyl phosphates; methyl glucose esters; protein condensates; alkoxylated alkyl sulphates; alkyl polyglucosides; alkyl amine oxides; betaines; sultaines: alkyl sulphosuccinates, dialkyl sulphosuccinates, acyl lactylates: fatty acid soaps; and mixtures thereof;

(b) about 25% to 60% by wt. of polyalkylene glycol;

(c) 5% to 2:5% $C_{12}$ to $C_{24}$ fatty acids or mixtures of fatty acids (d) 0.1% to 15% by wt. urea; and (e) 1% to 14% by wt. water.

2. A composition according to claim 1, comprising 2 to 10% fatty acid soap.

3. A composition according to claim 1 comprising about 20–50% polyalkylene glycol.

* * * * *